US006608021B1

(12) United States Patent
Westfield et al.

(10) Patent No.: US 6,608,021 B1
(45) **Date of Patent: *Aug. 19, 2003**

(54) GRANULAR DETERGENT COMPOSITION HAVING IMPROVED APPEARANCE AND SOLUBILITY

(75) Inventors: Jacqueline Westfield, Walton, KY (US); Steven Matthew Gabriel, Cincinnati, OH (US); Scott William Capeci, North Bend, OH (US); Kristin Nicole Perkis, Norwood, OH (US)

(73) Assignee: The Procter & Gamble Co., Cincinnati, OH (US)

( * ) Notice: Subject to any disclaimer, the term of this patent is extended or adjusted under 35 U.S.C. 154(b) by 0 days.

This patent is subject to a terminal disclaimer.

(21) Appl. No.: 09/787,852

(22) PCT Filed: Sep. 24, 1999

(86) PCT No.: PCT/US99/22393

§ 371 (c)(1),
(2), (4) Date: May 1, 2001

(87) PCT Pub. No.: WO00/18875

PCT Pub. Date: Apr. 6, 2000

Related U.S. Application Data

(63) Continuation of application No. PCT/US98/20223, filed on Sep. 25, 1998.
(60) Provisional application No. 60/105,826, filed on Oct. 27, 1998.

(51) Int. Cl.[7] ..... C11D 17/06
(52) U.S. Cl. ..... 510/444; 510/278; 8/137
(58) Field of Search ..... 510/278, 444; 8/137

(56) References Cited

U.S. PATENT DOCUMENTS

| | | | | | |
|---|---|---|---|---|---|
| 5,332,519 | A | | 7/1994 | Mazzola | 510/351 |
| 5,536,431 | A | * | 7/1996 | Carduck et al. | 510/444 |
| 5,554,587 | A | * | 9/1996 | Capeci | 510/444 |
| 5,646,107 | A | | 7/1997 | Emery et al. | 510/457 |
| 6,013,617 | A | * | 1/2000 | Boittiaux et al. | 510/509 |
| 6,294,512 | B1 | * | 9/2001 | Mort, III et al. | 510/438 |

FOREIGN PATENT DOCUMENTS

| | | | | |
|---|---|---|---|---|
| DE | 196 22 443 | A1 | | 12/1997 |
| EP | 0 816485 | A1 | | 1/1998 |
| JP | 6002000 | | | 1/1994 |
| WO | WO-98/01520 | A | * | 1/1998 |
| WO | WO 98/24876 | | | 6/1998 |

* cited by examiner

*Primary Examiner*—Lorna M. Douyon
(74) *Attorney, Agent, or Firm*—Julia A. Glazer; Brahm J. Corstanje; Kim W. Zerby

(57) ABSTRACT

A detergent composition which has improved solubility or dissolution in laundering solutions, especially in solutions kept at cold temperatures (i.e., less than about 30° C.), is disclosed. The granular detergent composition is aesthetically pleasing to consumers and has improved flowability. The granular detergent composition has optimally selected level of particles having a judiciously selected median particle size diameter with a selected standard deviation. The granular detergent composition also has carefully tailored physical properties such as uniformity parameter, whiteness, circularity and aspect ratio.

19 Claims, No Drawings

GRANULAR DETERGENT COMPOSITION HAVING IMPROVED APPEARANCE AND SOLUBILITY

This application is a 371 of PCT/US99/22393, filed Sep. 24, 1999, which claims benefit of No. 60/105,826, filed Oct. 27, 1998, which is a continuation of PCT/US98/20223, filed Sep. 25, 1998.

FIELD OF THE INVENTION

The present invention relates to an improved granular detergent composition which has superior solubility, especially in cold temperature laundering solutions (i.e., less than about 30° C.), excellent flowability, aesthetics or appearance and friability. More particularly, the detergent composition contains optimal levels of particles having optimally selected particle size and particle size distribution for achieving the desired improvements. The detergent composition also has a carefully tailored uniformity parameter, whiteness, circularity and aspect ratio.

BACKGROUND OF THE INVENTION

Recently, there has been considerable interest within the detergent industry for laundry detergents which have the convenience, aesthetics and solubility of liquid laundry detergent products, but retain the cleaning performance and cost of granular detergent products. The problems, however, associated with past granular detergent compositions with regard to aesthetics, solubility and user convenience are formidable. Such problems have been exacerbated by the advent of "compact" or low dosage granular detergent products which typically do not dissolve in washing solutions as well as their liquid laundry detergent counterparts. These low dosage detergents are currently in high demand as they conserve resources and can be sold in small packages which are more convenient for consumers prior to use, but less convenient upon dispensing into the washing machine as compared to liquid laundry detergent which can be simply poured directly from the bottle as opposed to "scooped" from the box and then dispensed into the washing solution.

As mentioned, such low dosage or "compact" detergent products unfortunately experience dissolution problems, especially in cold temperature laundering solutions (i.e., less than about 30° C.). More specifically, poor dissolution results in the formation of "clumps" which appear as solid white masses remaining in the washing machine or on the laundered clothes after conventional washing cycles. These "clumps" are especially prevalent under cold temperature washing conditions and/or when the order of addition to the washing machine is laundry detergent first, clothes second and water last (commonly known as the "Reverse Order Of Addition" or "ROOA"). Such undesirable "clumps" are also formed if the consumer loads the washing machine in the order of clothes, detergent and then water. Similarly, this clumping phenomenon can contribute to the incomplete dispensing of detergent in washing machines equipped with dispenser drawers or in other dispensing devices, such as a granulette. In this case, the undesired result is undissolved detergent residue in the dispensing device.

It has been found that the cause of the aforementioned dissolution problem is associated with the "bridging" of a "gel-like" substance between surfactant-containing particles to form undesirable "clumps." The gel-like substance responsible for the undesirable "bridging" of particles into "clumps" originates from the partial dissolution of surfactant in the aqueous laundering solutions, wherein such partial dissolution causes the formation of a highly viscous surfactant phase or paste which binds or otherwise "bridges" other surfactant-containing particles together into "clumps." This undesirable dissolution phenomena is commonly referred to as "lump-gel" formation. In addition to the viscous surfactant "bridging" effect, inorganic salts have a tendency to hydrate which can also cause "bridging" of particles which linked together via hydration. In particular, inorganic salts hydrate with one another to form a cage structure which exhibits poor dissolution and ultimately ends up as a "clump" after the washing cycle. It would therefore be desirable to have a detergent composition which does not experience the dissolution problems identified above so as to result in improved cleaning performance.

The prior art is replete with disclosures addressing the dissolution problems associated with granular detergent compositions. For example, the prior art suggests limiting the use and manner of inorganic salts which can cause clumps via the "bridging" of hydrated salts during the laundering cycle. Specific ratios of selected inorganic salts are contemplated so as to minimize dissolution problems. Such a solution, however, constricts the formulation and process flexibility which are necessary for current commercialization of large-scale detergent products. Various other mechanisms have been suggested by the prior art, all of which involve formulation alteration, and thereby reduce formulation flexibility. As a consequence, it would therefore be desirable to have a detergent composition having improved dissolution without significantly inhibiting formulation flexibility.

Accordingly, despite the disclosures in the prior art discussed previously, it would be desirable to have a granular detergent composition which exhibits improved solubility, is more aesthetically pleasing to consumers, has improved flowability and exhibits improved cleaning performance. Also, it would be desirable to have such a detergent composition which exhibits such improved dissolution without significantly inhibiting formulation flexibility.

SUMMARY OF THE INVENTION

The invention meets the needs above by providing a detergent composition which has improved solubility or dissolution in laundering solutions, especially in solutions kept at cold temperatures (i.e., less than about 30° C.), is aesthetically pleasing to consumers and has improved flowability. The granular detergent composition has optimally selected level of particles having a judiciously selected median particle size with a selected standard deviation. The granular detergent composition also has carefully tailored physical properties such as uniformity parameter, whiteness, circularity and aspect ratio.

In accordance with one aspect of the invention, a granular detergent composition with improved solubility, aesthetics and flowability is provided. The detergent composition comprises at least about 50% by weight of particles having a geometric mean particle diameter of from about 500 microns to about 1500 microns with a geometric standard deviation of from about 1 to about 2, wherein at least a portion of the particles contain a detersive surfactant and a detergent builder. The invention also provides a method of laundering soiled fabrics comprising the step of contacting the soiled fabrics with an aqueous solution containing an effective amount of a detergent composition according the invention described herein.

Accordingly, it is an advantage of the invention to provide a granular detergent composition which exhibits improved solubility, is more aesthetically pleasing to consumers, has improved flowability and exhibits improved cleaning performance. It is also an advantage to have such a detergent composition which exhibits such improved dissolution without significantly inhibiting formulation flexibility.

DETAILED DESCRIPTION OF THE PREFERRED EMBODIMENT

Definitions

As used herein, the word "particles" means the entire size range of a detergent final product or component or the entire size range of discrete particles, agglomerates, or granules in a final detergent product or component admixture. It specifically does not refer to a size fraction (i.e., representing less than 100% of the entire size range) of any of these types of particles unless the size fraction represents 100% of a discrete particle in an admixture of particles. For each type of particle component in an admixture, the entire size range of discrete particles of that type have the same or substantially similar composition regardless of whether the particles are in contact with other particles. For agglomerated components, the agglomerates themselves are considered as discrete particles and each discrete particle may be comprised of a composite of smaller primary particles and binder compositions. As used herein, the phrase "geometric mean particle diameter" means the geometric mass median diameter of a set of discrete particles as measured by any standard mass-based particle size measurement technique, preferably by dry sieving. As used herein, the phrase "geometric standard deviation" or "span" of a particle size distribution means the geometric breadth of the best-fitted log-normal function to the above-mentioned particle size data which can be accomplished by the ratio of the diameter of the 84.13 percentile divided by the diameter of the $50^{th}$ percentile of the cumulative distribution ($D_{84.13}/D_{50}$); See Gotoh et al, *Powder Technology Handbook*, pp. 6–11, Meral Dekker 1997.

As used herein, the phrase "builder" means any inorganic material having "builder" performance in the detergency context, and specifically, organic or inorganic material capable of removing water hardness from washing solutions. As used herein, the term "bulk density" refers to the uncompressed, untapped powder bulk density, as measured by pouring an excess of powder sample through a funnel into a smooth metal vessel (e.g., a 500 ml volume cylinder), scraping off the excess from the heap above the rim of the vessel, measuring the remaining mass of powder and dividing the mass by the volume of the vessel.

Physical Properties

The granular detergent composition achieves the desired benefits of solubility, improved aesthetics and flowability via optimal selection of the geometric mean particle diameter of certain levels of particles in the composition. By "improved aesthetics", it is meant that the consumer views a granular detergent product which has a more uniform appearance of particles as opposed to past granular detergent products which contained particles of varying size and composition. To that end, at least about 50%, more preferably at least about 75%, even more preferably at least about 90%, and most preferably at least about 95%, by weight of the total particles in the detergent product, have the selected mean particle size diameter. In this way, a substantial portion of the granular detergent product will have the uniform size so as to provide the aesthetic appearance desired by consumers.

Preferably, the geometric mean particle diameter of the particles is from about 500 microns to about 1500 microns, more preferably from about 600 microns to about 1200 microns, and most preferably from about 700 microns to about 1000 microns. The particle size distribution is defined by a relative tight geometric standard deviation or "span" so as not to have too many particles outside of the target size. Accordingly, the geometric standard deviation is preferably is from about 1 to about 2, more preferably is from about 1.0 to about 1.7, even more preferably is from about 1.0 to about 1.4, and most preferably is from about 1.0 to about 1.2. The average bulk density of the particles is preferably at least about 450 g/l, more preferably at least about 550 g/l, and most preferably at least about 650 g/l.

While not intending to be bound by theory, it is believed that solubility is enhanced as a result of the particles in the detergent composition being more of the same size. Specifically, as a result of the particles being more uniform in size, the actual "contact points" among the particles in the detergent composition is reduced which, in turn, reduces the "bridging effect" commonly associated with the "lump-gel" dissolution difficulties of granular detergent compositions. Previous granular detergent compositions contained particles of varying sizes which leads to more contact points among the particles. For example, a large particle could have many smaller particles in contact with it rendering the particle site ripe for lump-gel formation. The level and uniform size of the particles in the granular detergent composition of the present invention avoids such problems.

By "a portion" of the particles, it is meant that at least some particles in the detergent composition contain a detersive surfactant and/or a detergent builder to provide the fundamental building blocks of a typical detergent composition. The various surfactants and builders as well as their respective levels in the composition are set forth hereinafter. Typically, the detergent composition will contain from about 1% to about 50% by weight of a detersive surfactant and from about 1% to about 75% by weight of a detergent builder.

Color

A particularly important attribute of detergent powders is color. Color is usually measured on a Hunter Colorimeter and reported as three parameters "L", "a" and "b". Of particular relevance to the powdered detergent consumer is the whiteness of the powder determined by the equation L-3b. In general, whiteness values below about 60% are considered poor. Whiteness can be improved by a number of means known to those of ordinary skill in the art. For example, whiteness can be improved by coating granules with titanium dioxide.

In addition to the average whiteness of the bulk product, it is also important to have uniformity of color. Having a high percentage of particles of substantially different color can either skew the overall impression of the product (to appear more like the poorer colored granule) or at lower levels, make the product appear speckled. But it is understood that components present at very low levels, that is less than about 1% by weight, do not make any significant contribution to the overall appearance of the product. Color uniformity can be assessed two ways:

1. the difference between the highest (maximum) and lowest (minimum) whiteness; and
2. a "Uniformity Parameter", which is the maximum value of the following equation applied to all components in excess of 1% of the composition:

$$\text{Uniformity Parameter}=(1/\text{wt }\%x)*\text{Abs}(\text{whiteness}_x-\text{whiteness}_{bulk})$$

wherein: component x is a portion of the detergent composition that has a different level of whiteness compared to the bulk detergent;

$whiteness_x$=the whiteness level of component x as measured on a Hunter Colorimeter;

$whiteness_{bulk}$=the whiteness level of the bulk detergent as measured on a Hunter Colorimeter;

wt % x=the weight percent of component x;

Abs=the absolute value; and

Preferably the granular detergents of this invention have a whiteness of from about 60 to about 100, preferably from about 75 to about 100, more preferably from about 85 to about 100 and most preferably from about 92 to about 100. Also preferred are granular detergents where all components have a whiteness difference (maximum-minimum) of less than about 40, preferably less than 30, more preferably less than 20 and most preferably less than 10. The Granular detergents of this invention preferably have a Uniformity Parameter, as defined above, of less than about 200, more preferably less than about 100, even more preferably less than about 50, and most preferably less than about 25.

Shape

Another important attribute of the granular detergent products of this invention is the shape of the individual particles. Shape can be measured in a number of different ways known to those of ordinary skill in the art. One such method is using optical microscopy with Optimus (V5.0) image analysis software. Important calculated parameters are:

"Circularity" which is defined as (measured perimeter length of the particle image)$^2$/(measured area of the particle image). The circularity of a perfectly smooth sphere (minimum circularity) is 12.57; and "Aspect Ratio" which is defined as the length/width of the particle image.

Each of these attributes is important and can be averaged over the bulk granular detergent composition. Further, the combination of the two parameters as defined by the product of the parameters is important as well (i.e. both must be controlled to get a product with good appearance).

Preferably, the granular detergent compositions of this invention have circularity less than about 50, preferably less than about 30, more preferably less than about 23, most preferably less than about 18. Also preferred are granular detergent compositions with aspect ratios less than about 2, preferably less than about 1.5, more preferably less than about 1.3 most preferably less than about 1.2.

Additionally, it is preferred to have a uniform distribution of shapes among the particles in the composition. Specifically, the granular detergent compositions of this invention have a standard deviation of the number distribution of circularity less than about 20, that is preferably less than about 10, more preferably less than about 7 most preferably less than about 4. And the standard deviation of the number distribution of aspect ratios is preferably less than about 1, more preferably less than about 0.5, even more preferably less than about 0.3, most preferably less than about 0.2.

In an especially preferred process of the present invention, granular detergent compositions are produced wherein the product of circularity and aspect ratio is less than about 100, preferably less than about 50, more preferably less than about 30, and most preferably less than about 20. Also preferred are granular detergent compositions with the standard deviation of the number distribution of the product of circularity and aspect ratio of less than about 45, preferably less than about 20, more preferably less than about 7 most preferably less than about 2.

The preferred detergent compositions of this invention meet at least one and most preferably all, of the attribute measurements and standard deviations as defined above, that is for whiteness, color uniformity circularity and aspect ratio.

DETERGENT COMPONENTS

The surfactant system of the detergent composition may include anionic, nonionic, zwitterionic, ampholytic and cationic classes and compatible mixtures thereof. Detergent surfactants are described in U.S. Pat. No. 3,664,961, Norris, issued May 23, 1972, and in U.S. Pat. No. 3,919,678, Laughlin et al., issued Dec. 30, 1975, both of which are incorporated herein by reference. Cationic surfactants include those described in U.S. Pat. No. 4,222,905, Cockrell, issued Sep. 16, 1980, and in U.S. Pat. No. 4,239,659, Murphy, issued Dec. 16, 1980, both of which are also incorporated herein by reference.

Nonlimiting examples of surfactant systems include the conventional $C_{11}$–$C_{18}$ alkyl benzene sulfonates ("LAS") and primary, branched-chain and random $C_{10}$–$C_{20}$ alkyl sulfates ("AS"), the $C_{10}$–$C_{18}$ secondary (2,3) alkyl sulfates of the formula $CH_3(CH_2)_x(CHOSO_3^-M^+)CH_3$ and $CH_3(CH_2)_y(CHOSO_3^-M^+)CH_2CH_3$ where x and (y+1) are integers of at least about 7, preferably at least about 9, and M is a water-solubilizing cation, especially sodium, unsaturated sulfates such as oleyl sulfate, the $C_{10}$–$C_{18}$ alkyl alkoxy sulfates ("$AE_xS$"; especially EO 1–7 ethoxy sulfates), $C_{10}$–$C_{18}$ alkyl alkoxy carboxylates (especially the EO 1–5 ethoxycarboxylates), the $C_{10}$–$C_{18}$ glycerol ethers, the $C_{10}$–$C_{18}$ alkyl polyglycosides and their corresponding sulfated polyglycosides, and $C_{12}$–$C_{18}$ alpha-sulfonated fatty acid esters. If desired, the conventional nonionic and amphoteric surfactants such as the $C_{12}$–$C_{18}$ alkyl ethoxylates ("AE") including the so-called narrow peaked alkyl ethoxylates and $C_6$–$C_{12}$ alkyl phenol alkoxylates (especially ethoxylates and mixed ethoxy/propoxy), $C_{12}$–$C_{18}$ betaines and sulfobetaines ("sultaines"), $C_{10}$–$C_{18}$ amine oxides, and the like, can also be included in the surfactant system. The $C_{10}$–$C_{18}$ N-alkyl polyhydroxy fatty acid amides can also be used. Typical examples include the $C_{12}$–$C_{18}$ N-methylglucamides. See WO 9,206,154. Other sugar-derived surfactants include the N-alkoxy polyhydroxy fatty acid amides, such as $C_{10}$–$C_{18}$ N-(3-methoxypropyl) glucamide. The N-propyl through N-hexyl $C_{12}$–$C_{18}$ glucamides can be used for low sudsing. $C_{10}$–$C_{20}$ conventional soaps may also be used. If high sudsing is desired, the branched-chain $C_{10}$–$C_{16}$ soaps may be used. Mixtures of anionic and nonionic surfactants are especially useful. Other conventional useful surfactants are listed in standard texts.

The detergent composition can, and preferably does, include a detergent builder. Builders are generally selected from the various water-soluble, alkali metal, ammonium or substituted ammonium phosphates, polyphosphates, phosphonates, polyphosphonates, carbonates, silicates, borates, polyhydroxy sulfonates, polyacetates, carboxylates, and polycarboxylates. Preferred are the alkali metal, especially sodium, salts of the above. Preferred for use herein are the phosphates, carbonates, silicates, $C_{10}$–$C_{18}$ fatty acids, polycarboxylates, and mixtures thereof. More preferred are sodium tripolyphosphate, tetrasodium pyrophosphate, citrate, tartrate mono- and di-succinates, sodium silicate, and mixtures thereof (see below).

Specific examples of inorganic phosphate builders are sodium and potassium tripolyphosphate, pyrophosphate, polymeric metaphosphate having a degree of polymerization of from about 6 to 21, and orthophosphates. Examples of polyphosphonate builders are the sodium and potassium salts of ethylene diphosphonic acid, the sodium and potassium salts of ethane 1-hydroxy-1, 1-diphosphonic acid and the sodium and potassium salts of ethane, 1,1,2-triphosphonic acid. Other phosphorus builder compounds are disclosed in U.S. Pat. Nos. 3,159,581; 3,213,030; 3,422,021; 3,422,137; 3,400,176 and 3,400,148, all of which are incorporated herein by reference.

Examples of nonphosphorus, inorganic builders are sodium and potassium carbonate, bicarbonate, sesquicarbonate, tetraborate decahydrate, and silicates having a weight ratio of $SiO_2$ to alkali metal oxide of from about 0,5 to about 4.0, preferably from about 1.0 to about 2.4. Water-soluble, nonphosphorus organic builders useful herein include the various alkali metal, ammonium and substituted ammonium polyacetates, carboxylates, polycarboxylates and polyhydroxy sulfonates. Examples of polyacetate and polycarboxylate builders are the sodium, potassium, lithium, ammonium and substituted ammonium salts of ethylene diamine tetraacetic acid, nitrilotriacetic acid, oxydisuccinic acid, mellitic acid, benzene polycarboxylic acids, and citric acid.

Polymeric polycarboxylate builders are set forth in U.S. Pat. No. 3,308,067, Diehl, issued Mar. 7, 1967, the disclosure of which is incorporated herein by reference. Such materials include the water-soluble salts of homo- and copolymers of aliphatic carboxylic acids such as maleic acid, itaconic acid, mesaconic acid, fumaric acid, aconitic acid, citraconic acid and methylenemalonic acid. Some of these materials are useful as the water-soluble anionic polymer as hereinafter described, but only if in intimate admixture with the nonsoap anionic surfactant.

Other suitable polycarboxylates for use herein are the polyacetal carboxylates described in U.S. Pat. No. 4,144,226, issued Mar. 13, 1979 to Crutchfield et al., and U.S. Pat. No. 4,246,495, issued Mar. 27, 1979 to Crutchfield et al., both of which are incorporated herein by reference. These polyacetal carboxylates can be prepared by bringing together under polymerization conditions an ester of glyoxylic acid and a polymerization initiator. The resulting polyacetal carboxylate ester is then attached to chemically stable end groups to stabilize the polyacetal carboxylate against rapid depolymerization in alkaline solution, converted to the corresponding salt, and added to a detergent composition. Particularly preferred polycarboxylate builders are the ether carboxylate builder compositions comprising a combination of tartrate monosuccinate and tartrate disuccinate described in U.S. Pat. No. 4,663,071, Bush et al., issued May 5, 1987, the disclosure of which is incorporated herein by reference.

Water-soluble silicate solids represented by the formula $SiO_2.M_2O$, M being an alkali metal, and having a $SiO_2:M_2O$ weight ratio of from about 0.5 to about 4.0, are useful salts in the detergent granules of the invention at levels of from about 2% to about 15% on an anhydrous weight basis, preferably from about 3% to about 8%. Anhydrous or hydrated particulate silicate can be utilized, as well.

Any number of additional ingredients can also be included as components in the granular detergent composition. These include other detergency builders, bleaches, bleach activators, suds boosters or suds suppressors, anti-tarnish and anti-corrosion agents, soil suspending agents, soil release agents, germicides, pH adjusting agents, non-builder alkalinity sources, chelating agents, smectite clays, enzymes, enzyme-stabilizing agents and perfumes. See U.S. Pat. No. 3,936,537, issued Feb. 3, 1976 to Baskerville, Jr. et al., incorporated herein by reference.

Bleaching agents and activators are described in U.S. Pat. No. 4,412,934, Chung et al., issued Nov. 1, 1983, and in U.S. Pat. No. 4,483,781, Hartman, issued Nov. 20, 1984, both of which are incorporated herein by reference. Chelating agents are also described in U.S. Pat. No. 4,663,071, Bush et al., from Column 17, line 54 through Column 18, line 68, incorporated herein by reference. Suds modifiers are also optional ingredients and are described in U.S. Pat. No. 3,933,672, issued Jan. 20, 1976 to Bartoletta et al., and U.S. Pat. No. 4,136,045, issued Jan. 23, 1979 to Gault et al., both incorporated herein by reference.

Suitable smectite clays for use herein are described in U.S. Pat. No. 4,762,645, Tucker et al., issued Aug. 9, 1988, Column 6, line 3 through Column 7, line 24, incorporated herein by reference. Suitable additional detergency builders for use herein are enumerated in the Baskerville patent, Column 13, line 54 through Column 16, line 16, and in U.S. Pat. No. 4,663,071, Bush et al., issued May 5, 1987, both incorporated herein by reference.

The following examples are presented for illustrative purposes only and are not to be construed as limiting the scope of the appended claims in any way.

Abbreviations Used in Examples

In the detergent compositions, the abbreviated component identifications have the following meanings:

| | |
|---|---|
| LAS | Sodium linear C11–13 alkyl benzene sulfonate |
| TAS | Sodium tallow alkyl sulfate |
| CxyAS | Sodium Clx–Cly alkyl sulfate |
| C46SAS | Sodium C14–C16 secondary (2,3) alkyl sulfate |
| CxyEzS | Sodium Clx–Cly alkyl sulfate condensed with z moles of ethylene oxide |
| CxyEz | Clx–Cly predominantly linear primary alcohol condensed with an average of z moles of ethylene oxide |
| QAS | R2.N + (CH3)2(C2H4OH) with R2 = C12–C14 |
| QAS 1 | R2.N + (CH3)2(C2H4OH) with R2 = C8–C11 |
| APA | C8–C10 amido propyl dimethyl amine |
| Soap | Sodium linear alkyl carboxylate derived from an 80/20 mixture of tallow and coconut fatty acids |
| STS | Sodium toluene sulphonate |
| CFAA | C12–C14 (coco) alkyl N-methyl glucamide |
| TFAA | C16–C18 alkyl N-methyl glucamide |
| TPKFA | C12–C14 topped whole cut fatty acids |
| STPP | Anhydrous sodium tripolyphosphate |
| TSPP | Tetrasodium pyrophosphate |
| Zeolite A | Hydrated sodium aluminosilicate of formula Na12(AlO2SiO2)12.27H2O having a primary particle size in the range from 0.1 to 10 micrometers (weight expressed on an anhydrous basis) |
| NaSKS-6 | Crystalline layered silicate of formula δ-Na2Si2O5 |
| Citric acid | Anhydrous citric acid |
| Borate | Sodium borate |
| Carbonate | Anydrous sodium carbonate with a particle size between 200 μm and 900 μm |
| Bicarbonate | Anhydrous sodium bicarbonate with a particle size distribution between 400 μm and 1200 μm |
| Silicate | Amorphous sodium silicate (SiO2:Na2O = 2.0:1) |
| Sulfate | Anhydrous sodium sulfate |
| Mg sulfate | Anhydrous magnesium sulfate |
| Citrate | Tri-sodium citrate dihydrate of activity 86.4% with a particle size distribution between 425 μm and 850 μm |
| MA/AA | Copolymer of 1:4 maleic/acrylic acid, average molecular weight about 70,000 |
| MA/AA (1) | Copolymer of 4:6 maleic/acrylic acid, average molecular weight about 10,000 |
| AA | Sodium polyacrylate polymer of average molecular weight 4,500 |
| CMC | Sodium carboxymethyl cellulose |
| Cellulose ether | Methyl cellulose ether with a degree of polymerization of 650 available from Shin Etsu Chemicals |
| Protease | Proteolytic enzyme, having 3.3% by weight of active enzyme, sold by NOVO Industries A/S under the tradename Savinase |

-continued

| | |
|---|---|
| Protease I | Proteolytic enzyme, having 4% by weight of active enzyme, as described in WO 95/10591, sold by Genencor Int. Inc. |
| Alcalase | Proteolytic enzyme, having 5.3% by weight of active enzyme, sold by NOVO Industries A/S |
| Cellulase | Cellulytic enzyme, having 0.23% by weight of active enzyme, sold by NOVO Industries A/S under the tradename Carezyme |
| Amylase | Amylolytic enzyme, having 1.6% by weight of active enzyme, sold by NOVO Industries A/S under the tradename Termamyl 120T |
| Lipase | Lipolytic enzyme, having 2.0% by weight of active enzyme, sold by NOVO Industries A/S under the tradename Lipolase |
| Lipase (1) | Lipolytic enzyme, having 2.0% by weight of active enzyme, sold by NOVO Industries A/S under the tradename Lipolase Ultra |
| Endolase | Endoglucanase enzyme, having 1.5% by weight of active enzyme, sold by NOVO Industries A/S |
| PB4 | Sodium perborate tetrahydrate of nominal formula NaBO2.3H2 O.H202— |
| PB1 | Anhydrous sodium perborate bleach of nominal formula NaBO2.H 2O2 |
| Percarbonate | Sodium percarbonate of nominal formula 2Na2CO3.3H2O2 |
| NOBS | Nonanoyloxybenzene sulfonate in the form of the sodium salt |
| NAC-OBS | (6-nonamidocaproyl) oxybenzene sulfonate |
| TAED | Tetraacetylethylenediamine |
| DTPA | Diethylene triamine pentaacetic acid |
| DTPMP | Diethylene triamine penta (methylene phosphonate), marketed by Monsanto under the Tradename Dequest 2060 |
| EDDS | Ethylenediamine-N,N'-disuccinic acid, (S,S) isomer in the form of its sodium salt. |
| Photo-activated | Sulfonated zinc phthlocyanine encapsulated in bleach (1) dextrin soluble polymer |
| Photo-activated | Sulfonated alumino phthlocyanine encapsulated in bleach (2) dextrin soluble polymer |
| Brightener 1 | Disodium 4,4'-bis(2-sulphostyryl)biphenyl |
| Brightener 2 | Disodium 4,4'-bis(4-anilino-6-morpholino-1.3.5-triazin-2-yl)amino) stilbene-2:2'-disulfonate |

-continued

| | |
|---|---|
| HEDP | 1,1-hydroxyethane diphosphonic acid |
| PEGx | Polyethylene glycol, with a molecular weight of x (typically 4,000) |
| PEO | Polyethylene oxide, with an average molecular weight of 50,000 |
| TEPAE | Tetraethylenepentaamine ethoxylate |
| PVI | Polyvinyl imidosole, with an average molecular weight of 20,000 |
| PVP | Polyvinylpyrolidone polymer, with an average molecular weight of 60,000 |
| PVNO | Polyvinylpyridine N-oxide polymer, with an average molecular weight of 50,000 |
| PVPVI | Copolymer of polyvinylpyrolidone and vinylimidazole, with an average molecular weight of 20,000 |
| QEA | bis((C2H5O)(C2H4O)n)(CR3)—N + —C6H12—N + —(CH3)bis((C2H5O)—(C2H4 O))n, wherein n = from 20 to 30 |
| SRP 1 | Anionically end capped poly esters |
| SRP 2 | Diethoxylated poly (1,2 propylene terephtalate) short block polymer |
| PEI | Polyethyleneimine with an average molecular weight of 1800 and an average ethoxylation degree of 7 ethyleneoxy residues per nitrogen |
| Silicone antifoam | Polydimethylsiloxane foam controller with siloxane-oxyalkylene copolymer as dispersing agent with a ratio of said foam controller to said dispersing agent of 10:1 to 100:1 |
| Opacifier | Water based monostyrene latex mixture, sold by BASF Aktiengesellschaft under the tradename Lytron 621 |
| Wax | Paraffin wax |

In the following examples all levels are quoted as % by weight of the composition:

EXAMPLE I

The following compositions are in accordance with the invention.

| | A | B | C | D | E | F | G | H | I |
|---|---|---|---|---|---|---|---|---|---|
| Spray-dried Granules | | | | | | | | | |
| LAS | 10.0 | 10.0 | 15.0 | 5.0 | 5.0 | 10.0 | — | — | — |
| TAS | — | 1.0 | — | | | | — | — | — |
| MBAS | — | — | | 5.0 | 5.0 | | — | — | — |
| $C_{45}AS$ | — | — | 1.0 | | 2.0 | 2.0 | — | — | — |
| $C_{34}AE_3S$ | — | — | | 1.0 | | | — | — | — |
| QAS | | | 1.0 | 1.0 | | | — | — | — |
| DTPA, HEDP and/or EDDS | 0.3 | 0.3 | 0.5 | 0.3 | | | — | — | — |
| MgSO4 | 0.5 | 0.5 | 0.1 | — | | | — | — | — |
| Sodium citrate | — | — | — | 3.0 | 5.0 | | — | — | — |
| Sodium carbonate | 10.0 | 7.0 | 15.0 | | | 10.0 | — | — | — |
| Sodium sulphate | 5.0 | 5.0 | — | — | 5.0 | 3.0 | — | — | — |
| Sodium silicate 1.6R | — | — | — | — | 2.0 | | — | — | — |
| Zeolite A | 16.0 | 18.0 | 20.0 | 20.0 | — | — | — | — | — |
| SKS-6 | — | — | — | 3.0 | 5.0 | — | — | — | — |
| MA/AA or AA | 1.0 | 2.0 | 11.0 | — | — | 2.0 | — | — | — |
| PEG 4000 | — | 2.0 | — | 1.0 | — | 1.0 | — | — | — |
| QEA | 1.0 | — | — | — | 1.0 | — | — | — | — |
| Brightener | 0.05 | 0.05 | 0.05 | — | 0.05 | — | — | — | — |
| Silicone oil | 0.01 | 0.01 | 0.01 | — | — | 0.01 | — | — | — |
| Agglomerate | | | | | | | | | |
| LAS | | | — | — | — | — | 2.0 | 2.0 | — |
| MBAS | | | — | — | — | — | — | — | 1.0 |
| $C_{45}AS$ | | | — | — | — | — | 2.0 | — | — |
| $AE_3$ | | | — | — | — | — | — | 1.0 | 0.5 |
| Carbonate | | | — | — | 4.0 | 1.0 | 1.0 | 1.0 | — |
| Sodium citrate | | | — | — | — | — | — | — | 5.0 |
| CFAA | | | | | — | — | — | — | — |

-continued

| | A | B | C | D | E | F | G | H | I |
|---|---|---|---|---|---|---|---|---|---|
| Citric acid | | | — | — | — | 4.0 | — | 1.0 | 1.0 |
| QEA | | | — | — | — | 2.0 | 2.0 | 1.0 | — |
| SRP | | | — | — | — | 1.0 | 1.0 | 0.2 | — |
| Zeolite A | | | — | — | — | 15.0 | 26.0 | 15.0 | 16.0 |
| Sodium silicate | | | — | — | — | — | — | — | — |
| PEG | — | — | — | — | — | — | 4.0 | — | — |
| Builder Agglomerates | | | | | | | | | |
| SKS-6 | 6.0 | — | — | — | 6.0 | 3.0 | — | 7.0 | 10.0 |
| LAS | 4.0 | 5.0 | — | — | 5.0 | 3.0 | — | 10.0 | 12.0 |
| Dry-add particulate components | | | | | | | | | |
| Maleic acid/carbonate/bicarbonate (40:20:40) | 8.0 | 10.0 | 10.0 | 4.0 | — | 8.0 | 2.0 | 2.0 | 4.0 |
| QEA | — | — | — | 0.2 | 0.5 | — | — | — | — |
| NACAOBS | 3.0 | — | — | 1.5 | — | — | — | 2.5 | — |
| NOBS | — | 3.0 | 3.0 | — | — | — | — | — | 5.0 |
| TAED | 2.5 | — | — | 1.5 | 2.5 | 6.5 | — | 1.5 | — |
| MBAS | — | — | — | 8.0 | — | — | 8.0 | — | 4.0 |
| LAS (flake) | 10.0 | 10.0 | — | — | — | — | — | 8.0 | — |
| Spray-on | | | | | | | | | |
| Brightener | 0.2 | 0.2 | 0.3 | 0.1 | 0.2 | 0.1 | — | 0.6 | — |
| Dye | — | — | — | 0.3 | 0.05 | 0.1 | — | — | — |
| AE7 | — | — | — | — | — | 0.5 | — | 0.7 | — |
| Perfume | — | — | — | 0.8 | — | 0.5 | — | 0.5 | — |
| Dry-add | | | | | | | | | |
| Citrate | — | — | 20.0 | 4.0 | — | 5.0 | 15.0 | — | 5.0 |
| Percarbonate | 15.0 | 3.0 | 6.0 | 10.0 | — | — | — | 18.0 | 5.0 |
| Perborate | — | — | — | — | 6.0 | 18.0 | — | — | — |
| Photobleach | 0.02 | 0.02 | 0.02 | 0.1 | 0.05 | — | 0.3 | — | 0.03 |
| Enzymes (cellulase, amylase, protease, lipase) | 1.3 | 0.3 | 0.5 | 0.5 | 0.8 | 2.0 | 0.5 | 0.16 | 0.2 |
| Carbonate | 0.0 | 10.0 | — | — | — | 5.0 | 8.0 | 10.0 | 5.0 |
| Perfume (encapsulated) | 0.6 | 0.5 | 0.5 | — | 0.3 | 0.5 | 0.2 | 0.1 | 0.6 |
| Suds suppressor | 1.0 | 0.6 | 0.3 | — | 0.10 | 0.5 | 1.0 | 0.3 | 1.2 |
| Soap | 0.5 | 0.2 | 0.3 | 3.0 | 0.5 | — | — | 0.3 | — |
| Citric acid | — | — | — | 6.0 | 6.0 | — | — | — | 5.0 |
| Dyed carbonate (blue, green) | 0.5 | 0.5 | 1.0 | 2.0 | — | 0.5 | 0.5 | 0.5 | 1.0 |
| SKS-6 | — | — | — | 4.0 | — | — | — | 6.0 | — |
| Fillers up to 100% | | | | | | | | | |

The compositions exemplified above have at least 90% by weight of particles having a geometric mean particle diameter of from about 850 microns with a geometric standard deviation of from about 1.2. Unexpectedly, the compositions have improved aesthetics, flowability and solubility.

EXAMPLE II

The following compositions are in accordance with the invention.

| | A | B | C | D | E | F | G | H | I |
|---|---|---|---|---|---|---|---|---|---|
| Spray-Dried Granules | | | | | | | | | |
| LAS | 10.0 | 10.0 | 16.0 | 5.0 | 5.0 | 10.0 | — | — | — |
| TAS | — | 1.0 | — | | | | — | — | — |
| MBAS | — | — | — | 5.0 | 5.0 | | — | — | — |
| $C_{45}AS$ | — | — | 1.0 | | 2.0 | 2.0 | — | — | — |
| $C_{45}AE_3S$ | — | — | — | 1.0 | | | — | — | — |
| QAS | — | — | 1.0 | 1.0 | | | — | — | — |
| DTPA, HEDP and/or EDDS | 0.3 | 0.3 | 0.3 | 0.3 | | | — | — | — |
| MgSO4 | 0.5 | 0.4 | 0.1 | — | | | — | — | — |
| Sodium citrate | 10.0 | 12.0 | 17.0 | 3.0 | 5.0 | | — | — | — |
| Sodium carbonate | 15.0 | 8.0 | 15.0 | | | 10.0 | — | — | — |
| Sodium sulphate | 5.0 | 5.0 | — | — | 5.0 | 3.0 | — | — | — |
| Sodium silicate 1.6R | — | — | — | — | 2.0 | | — | — | — |
| Zeolite A | — | — | — | 2.0 | — | — | — | — | — |

-continued

| | A | B | C | D | E | F | G | H | I |
|---|---|---|---|---|---|---|---|---|---|
| SKS-6 | — | — | — | 3.0 | 5.0 | — | — | — | — |
| MA/AA or AA | 1.0 | 2.0 | 10.0 | — | — | 2.0 | — | — | — |
| PEG 4000 | — | 2.0 | — | 1.0 | — | 1.0 | — | — | — |
| QEA | 1.0 | — | — | — | 1.0 | — | — | — | — |
| Brightener | 0.05 | 0.05 | 0.05 | — | 0.05 | — | — | — | — |
| Silicone oil | 0.01 | 0.01 | 0.01 | — | — | 0.01 | — | — | — |
| Agglomerate | | | | | | | | | |
| LAS | — | — | — | — | — | — | 2.0 | 2.0 | — |
| MBAS | — | — | — | — | — | — | — | — | 1.0 |
| $C_{45}AS$ | — | — | — | — | — | — | 2.0 | — | — |
| $AE_3$ | — | — | — | — | — | — | — | 1.0 | 0.5 |
| Carbonate | — | — | — | — | 4.0 | 1.0 | 1.0 | 1.0 | — |
| Sodium citrate | — | — | — | — | — | — | — | — | 5.0 |
| CFAA | — | — | — | | — | — | — | — | — |
| Citric acid | — | — | — | — | — | 4.0 | — | 1.0 | 1.0 |
| QEA | — | — | — | — | — | 2.0 | 2.0 | 1.0 | — |
| SRP | — | — | — | — | — | 1.0 | 1.0 | 0.2 | — |
| Zeolite A | — | — | — | — | — | 15.0 | 26.0 | 15.0 | 16.0 |
| Sodium silicate | — | — | — | — | — | — | — | — | — |
| PEG | — | — | — | — | — | — | 4.0 | — | — |
| Builder Agglomerate | | | | | | | | | |
| SKS-6 | 6.0 | 5.0 | — | — | 6.0 | 3.0 | — | 7.0 | 10.0 |
| LAS | 4.0 | 5.0 | — | — | 5.0 | 3.0 | — | 10.0 | 12.0 |
| Dry-add particulate components | | | | | | | | | |
| Maleic acid/ carbonate/bicarbonate (40:20:40) | 8.0 | 10.0 | 4.0 | 4.0 | — | 8.0 | 2.0 | 2.0 | 4.0 |
| QEA | — | — | — | 0.2 | 0.5 | — | — | — | — |
| NACAOBS | 3.0 | — | — | 1.5 | — | — | — | 2.5 | — |
| NOBS | — | 3.0 | 3.0 | — | — | — | — | — | 5.0 |
| TAED | 2.5 | — | — | 1.5 | 2.5 | 6.5 | — | 1.5 | — |
| MBAS | — | — | — | 8.0 | — | — | 8.0 | — | 4.0 |
| LAS (flake) | — | — | — | — | — | — | — | 8.0 | — |
| Spray-on | | | | | | | | | |
| Brightener | 0.2 | 0.2 | 0.3 | 0.1 | 0.2 | 0.1 | — | 0.6 | — |
| Dye | — | — | — | 0.3 | 0.05 | 0.1 | — | — | — |
| AE7 | — | — | — | — | — | 0.5 | — | 0.7 | — |
| Perfume | — | — | — | 0.8 | — | 0.5 | — | 0.5 | — |
| Dry-add | | | | | | | | | |
| Citrate | 4.0 | — | 3.0 | 4.0 | — | 5.0 | 15.0 | — | 5.0 |
| Percarbonate | 15.0 | 3.0 | 6.0 | 10.0 | — | — | — | 18.0 | 5.0 |
| Perborate | — | — | — | — | 6.0 | 18.0 | — | — | — |
| Photobleach | 0.02 | 0.02 | 0.02 | 0.1 | 0.05 | — | 0.3 | — | 0.03 |
| Enzymes (cellulase, amylase, protease, lipase) | 1.5 | 0.3 | 0.5 | 0.5 | 0.8 | 2.0 | 0.5 | 0.16 | 0.2 |
| Carbonate | — | — | — | — | — | 5.0 | 8.0 | 10.0 | 5.0 |
| Perfume (encapsulated) | 0.6 | 0.5 | 0.5 | — | 0.3 | 0.5 | 0.2 | 0.1 | 0.6 |
| Suds suppressor | 1.0 | 0.6 | 0.3 | — | 0.10 | 0.5 | 1.0 | 0.3 | 1.2 |
| Soap | 0.5 | 0.2 | 0.3 | 3.0 | 0.5 | — | — | 0.3 | — |
| Citric acid | — | — | — | 6.0 | 6.0 | — | — | — | 5.0 |
| Dyed carbonate (blue, green) | 0.5 | 0.5 | ? | 2.0 | — | 0.5 | 0.5 | 0.5 | 1.0 |
| SKS-6 | — | — | — | 4.0 | — | — | — | 6.0 | — |
| Fillers up to 100% | | | | | | | | | |

The compositions exemplified above have at least 90% by weight of particles having a geometric mean particle diameter of from about 850 microns with a geometric standard deviation of from about 1.2. Unexpectedly, the compositions have improved aesthetics, flowability and solubility.

Having thus described the invention in detail, it will be obvious to those skilled in the art that various changes may be made without departing from the scope of the invention and the invention is not to be considered limited to what is described in the specification.

What is claimed is:

1. A granular detergent composition comprising at least about 50% by weight of particles having a geometric mean particle diameter of from 700 microns to about 1500 microns with a geometric standard deviation of from about 1 to about 2, and a Uniformity Parameter of less than about 200 wherein at least a portion of said particles contain an anionic detersive surfactant a detergent builder and wherein said granular detergent composition is free of nonionic surfactant and alkali metal silicate.

2. The granular detergent composition of claim 1 wherein said particles comprise at least about 75% by weight of said detergent composition.

3. The granular detergent composition of claim 1 wherein the geometric standard deviation is from about 1.0 to about 1.7.

4. The granular detergent composition of claim 1 wherein the geometric standard deviation is from about 1.0 to about 1.4.

5. The granular detergent composition of claim 1 wherein said particles comprise at least about 90% by weight of said detergent composition.

6. The granular detergent composition of claim 1 wherein the geometric mean particle diameter of said particles are from 700 microns to about 1200 microns.

7. The granular detergent composition of claim 1 wherein the geometric mean particle diameter of said particles are from 700 microns to about 1000 microns.

8. The granular detergent composition of claim 1 wherein the geometric standard deviation is from about 1.0 to about 1.2.

9. The granular detergent composition of claim 1 wherein said particles comprise at least about 95% by weight of said detergent composition.

10. The granular detergent composition of claim 1 wherein said particles have a whiteness in a range of from about 60 to about 100.

11. The granular detergent composition of claim 10 wherein said particles have a whiteness in a range of from about 75 to about 100.

12. The granular detergent composition of claim 11 wherein said particles have a whiteness in a range of from about 92 to about 100.

13. The granular detergent composition of claim 1 wherein said particles have a Uniformity Parameter less than about 100.

14. The granular detergent composition of claim 13 wherein said particles have a Uniformity Parameter less than about 25.

15. The granular detergent composition of claim 1 wherein said particles have a circularity less than about 50.

16. The granular detergent composition of claim 15 wherein said particles have a circularity less than about 30.

17. The granular detergent composition of claim 1 wherein said particles have an aspect ratio less than about 2.

18. The granular detergent composition of claim 1 wherein said particles have an aspect ratio less than about 1.3.

19. A method of laundering soiled fabrics comprising the step of contacting said soiled fabrics with an aqueous solution containing an effective amount of a detergent composition according to claim 1.

* * * * *